US006508465B1

(12) United States Patent
Endo

(10) Patent No.: US 6,508,465 B1
(45) Date of Patent: Jan. 21, 2003

(54) SHEET FEEDER WITH DYNAMIC SPEED CONTROL

(75) Inventor: Kenji Endo, Fukushima (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 08/925,648

(22) Filed: Sep. 9, 1997

(30) Foreign Application Priority Data

Sep. 12, 1996 (JP) ..... 8-242176
Jun. 20, 1997 (JP) ..... 9-164480

(51) Int. Cl.[7] ..... B65H 7/18

(52) U.S. Cl. ..... 271/265.01; 271/265.04; 271/265.02

(58) Field of Search ..... 271/3.17, 4.03, 271/10, 10.03, 110, 111, 258, 121, 122, 123, 124, 125, 126, 127, 147, 265.01, 265.02, 265.04

(56) References Cited

U.S. PATENT DOCUMENTS 4,919,412 A * 4/1990 Weigel et al. ..... 271/110
5,186,449 A * 2/1993 Ohmi et al. ..... 271/111 X
5,197,726 A * 3/1993 Nogami ..... 271/110
5,201,508 A * 4/1993 Kuo ..... 271/10
5,328,163 A * 7/1994 Yamada ..... 271/10.01
5,342,037 A * 8/1994 Martin ..... 271/111
5,471,290 A * 11/1995 Nagayama et al. ..... 271/259 X
5,482,265 A * 1/1996 Nakazato et al. ... 271/265.01 X
5,692,741 A * 12/1997 Nakamura et al. ..... 271/10.03
5,924,686 A * 7/1999 Jacobson et al. ..... 271/3.17
5,927,703 A * 7/1999 Endo ..... 271/10.03

FOREIGN PATENT DOCUMENTS

| | | |
|---|---|---|
| JP | 59-108634 | 6/1984 |
| JP | 59-172339 | 9/1984 |
| JP | 62-113142 | 7/1987 |
| JP | 2-144335 | 6/1990 |
| JP | 4-39228 | 2/1992 |
| JP | 6-127723 | 5/1994 |
| JP | 406312852 | * 11/1994 |
| JP | 407325970 | * 12/1995 |
| JP | 9-26678 | 1/1997 |

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

A sheet feeding apparatus for image processing systems such as a stencil duplicating machine or a copying machine comprises a sheet feeding time sensor, and a control unit. The control unit compares a sheet feeding time detected by the sheet feeding time sensor with a predetermined reference sheet feeding time, and controls a revolution speed of a sheet feeding roller during or after a sheet feeding operation.

27 Claims, 8 Drawing Sheets

SHEET FEEDER WITH DYNAMIC SPEED CONTROL

BACKGROUND OF THE INVENTION

1. Field of the Invention

This invention relates to a sheet feeding apparatus for feeding sheets (including original documents) in image processing systems such as a printer, a copying machine, and a stencil duplicating machine.

2. Discussion of the Background

FIG. 10 of the accompanying drawings shows a sheet feeding apparatus for a stencil duplicating machine. In operation, a sheet feed roller 202 (called "the feed roller 202") successively pays out sheets 201 from a sheet tray 200 from top to bottom. Each paid out sheet 201 is separated from the remaining sheets 201 by a separating roller 203 and a separating pad 204, and is fed into a space between a pair of register rollers 205. The register rollers 205 are rotated in synchronization with the rotation of a printing drum 206, so that an image perforated on a stencil wrapped around the printing drum 206 is transferred (or printed) onto the sheet 201. Thereafter, the sheet 201 is conveyed to a discharge tray 208 via an absorbing unit 207.

The feed roller 202 has at least a surface made of a material with a high friction coefficient such as rubber. A frictional force between the feed roller 202 and a top sheet 201 is designed to be larger than a frictional force between the sheets 201. The former frictional force depends upon a sheet feeding pressure (i.e. a pressure applied by the feed roller 202 to the sheets 201). The smaller the sheet feeding pressure, the oftener the feed roller 202 slips on the sheet 201, and fails to pay it out. Conversely, the larger the sheet feeding pressure (called the "feeding pressure"), the oftener the feed roller 202 feeds a plurality of sheets 201 at a time.

Therefore, it is necessary to maintain the feeding pressure constant, since it is continuously variable with factors such as a kind, a size and an amount of sheets 201, a printing speed, and so on. Referring to FIG. 10, a sheet feeding pressure regulator 209 (called the "feeding pressure regulator 209") regulates the feeding pressure, and includes an arm 211 which is connected at its base to a stationary shaft 210, has a weight 212 at its free end, and is longitudinally movable at the free end. The arm 211 supports the feed roller 202 at the free end, so that the feed roller 202 is freely rotatable. The feeding pressure regulator 209 urges the arm 211 upward via a spring 214 connected to a side plate of the stencil duplicating machine via a regulating member 213. The regulating member 213 includes a plurality of hooks, with which the spring 214 is engaged so as to regulate the feeding pressure.

A pressure by which the sheets 201 comes into contacts with the separating roller 203 affects sheet separating functions. A separating pressure regulator 215 is provided in order to regulate this pressure, and comprises a spring 216 which is engaged with the separating pad 204 at its one end, and with a member 217 at the other end thereof. The member 217 or the separating pad 204 includes a plurality of hooks (not shown in FIG. 10) to which the spring .216 is secured so as to regulate a pressure applied by the separating pad 204 to the sheet separating roller 203, i.e. a sheet separating pressure (called the "separating pressure").

In the prior art shown in FIG. 10, in order to regulate the sheet feeding or separating pressure, it is necessary for an operator to manually change a position for securing the spring with a hook, which is very troublesome. Further, the sheet feeding or separating pressure delicately varies with kinds of sheets (e.g. thickness and quality of paper). Thus, this adjustment requires dexterity and quick response of the operator, and is not performed so reliably.

Japanese Patent Laid-Open Publication No. Sho 62-201736 proposed a sheet feeding mechanism which is intended to overcome the foregoing problems of troublesome manual operation and reduced reliability.

In this sheet feeding mechanism, when a sheet kind is input, a voltage which is associated with an optimum sheet feeding position for the specified sheet kind stored in a memory is compared with a voltage which is associated with an actual position of the sheets detected by a sheet feeding position detecting member. A hopper housing sheets is moved to its optimum position, and a feeding pressure, a separating pressure and rotation of a sheet feeding roller are controlled.

Specifically, as soon as initial conditions such as a size and kind of sheet and a printing speed are specified, the optimum sheet feeding data are retrieved from data stored in the memory.

In order to reliably feed each sheet to a printing section, the sheet feeding apparatus is continuously required to maintain appropriate sheet feeding and separating pressures in accordance with the kinds of sheets. However, it does not always follow that once the sheet feeding and separating pressures are appropriately determined in accordance with the kinds of sheets, neither no-sheet feeding nor multiple sheet feeding should take place.

This is because factors affecting the sheet feeding and separating pressures, i.e. the thickness and quality of sheets, tend to vary with environmental conditions in the stencil duplicating machine (e.g. temperature, humidity and so on).

The sheet feeding mechanism of the foregoing publication can overcome the problems caused by troublesome and reliable manual adjustment. However, when an optimum value is automatically determined in accordance with one initial condition, it is applied throughout the sheet feeding operation related to the initial condition. The sheet feeding mechanism is difficult to comply with conditions varying with time.

Therefore, it is very difficult for this sheet feeding mechanism to precisely and reliably prevent no-sheet feeding or multiple sheet feeding.

Further, the foregoing sheet feeding apparatus is disadvantageous in the following respect: no-sheet feeding caused by a worn feed roller; or waste of time when the operation is suspended in order to exchange a worn-out feed roller. At present, no particular measures have been taken from this viewpoint.

SUMMARY OF THE INVENTION

The present invention is intended to provide a sheet feeding apparatus which can automatically determine sheet feeding parameters such as sheet feeding and separating pressures, a sheet feeding time and so on in accordance with sheet feeding conditions such as a kind of sheet, a printing speed and so forth, adapt itself to varying sheet feeding conditions, and reliably minimize occurrences of no-sheet feeding and multiple sheet feeding.

Further, the invention is intended to provide a sheet feeding apparatus which can prevent problems caused by a sheet feed roller which wears with time.

In accordance with the invention, there is provided a sheet feeding apparatus for an image processing system which includes register rollers periodically conveying sheets from a sheet feed roller to a printing section. The sheet feeding apparatus mainly comprises a sheet feeding time sensor for detecting a sheet feeding time of a sheet, and a control unit. The sheet feeding time sensor is positioned upstream of the register rollers in a sheet feed path. The control unit compares the sheet feeding time detected by the sheet feeding time sensor with an experimentally predetermined reference sheet feeding time, and controls a revolution speed of the sheet feed roller on the basis of a compared result during or after a sheet feeding operation.

The sheet feeding apparatus continuously monitors a state of sheets which are being conveyed, and feeds sheets in an optimum state in response to any change in the sheet feeding conditions.

Other objects, advantages and novel features of the present invention will become apparent from the following detailed description of the invention when considered in conjunction with the accompanying drawings.

BRIEF DESCRIPTION OF THE DRAWINGS

The invention will become more fully understood from the detailed description given by way of illustration only, and thus are not limitative of the present invention. In all Figures, identical parts have identical reference numbers.

DETAILED DESCRIPTION OF THE PREFERRED EMBODIMENTS

The invention will be described with reference to an embodiment (applied to a stencil duplicating machine 2 as an image processing system) shown in FIGS. 1 to 6.

Figure 1:
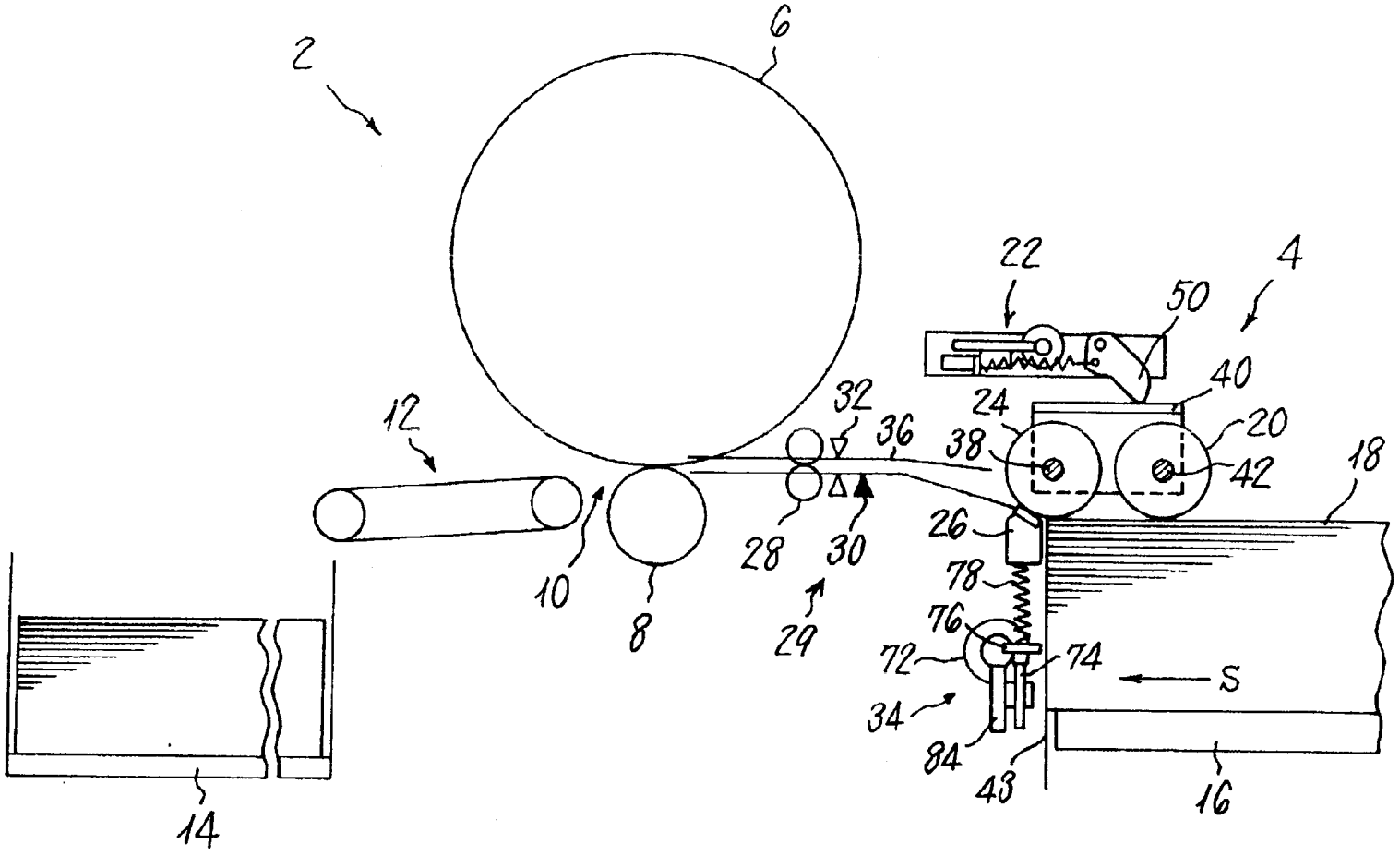
FIG. 1 is a schematic side view of a stencil duplicating machine into which a sheet feeding apparatus is incorporated in accordance with an embodiment of the invention.

Referring to FIG. 1, the stencil duplicating machine 2 mainly comprises a sheet feeding apparatus 4, a printing section 10 (including a printing drum 6 and a press roller 8), an absorbing unit 12, and a printed sheet tray 14.

The sheet feeding apparatus 4 includes a sheet feed roller 20 (called the "feed roller 20"), a feeding pressure regulator 22, a separating roller 24, a separating pad 26, a separating pressure regulator 34, a pair of register rollers 28, a sheet feeding time sensor 29, a control unit 93 (refer to FIG. 4), a multiple sheet feeding sensor 32, and a pair of sheet guides 36 as a sheet feed path.

The feed roller 20 pays sheets 18 out from a sheet tray 16 toward the printing section 10. The feeding pressure regulator 22 regulates a sheet feeding pressure of the feed roller 20 toward the sheets 18. The separating roller 24 and the separating pad 26 in close contact with the roller 24 cooperate to prevent multiple sheet feeding. The separating pressure regulator 34 regulates a separating pressure of the separating pad 26 toward the sheets 18. The register rollers 28 periodically feed sheets 18 to the printing section 10. The sheet feeding time sensor 29 detects a time for feeding each sheet (called the "sheet feeding time" hereinafter), and is positioned along the sheet feed path and upstream of the register rollers 28.

In this embodiment, the sheet feeding time sensor 29 includes a sensing element 30 for detecting a leading edge of the sheet 18. The control unit 93 actually calculates the sheet feeding time.

The separating roller 24 and a feed arm 40 are rotatably supported on a shaft 38 which is attached to a predetermined position on a side plate (not shown) of the stencil duplicating machine 2. The feed roller 20 is supported by a free end of the feed arm 40 via a shaft 42.

Both the sheet feed roller 20 and the feed arm 40 as an integral unit are longitudinally movable via the shaft 38 functioning as a fulcrum. The feed roller 20 and the separating roller 24 are connected to a motor (not shown) for activating the feed roller 20. In FIG. 1, reference numeral 43 denotes a front plate for aligning the leading edges of sheets 18 on the sheet tray 16.

Figure 2:
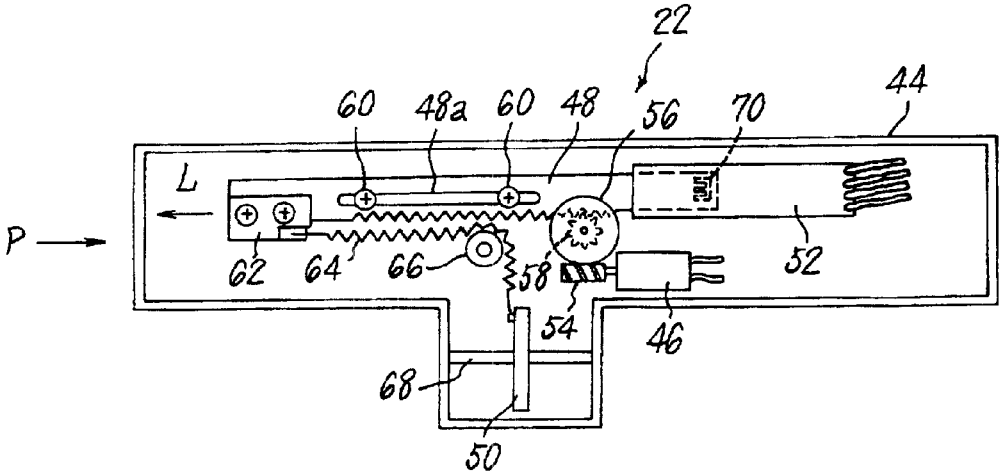
FIG. 2 is an enlarged top view of a feeding pressure regulator.

Referring to FIG. 2, the feeding pressure regulator 22 mainly includes a feed stay 44, a feeding pressure varying motor 46, a rack 48, a pressure applying arm 50, and a position detecting substrate 52. The rack 48 is movable transversely of the sheets 18 by the feeding pressure varying motor 46. The pressure applying arm 50 applies a pressure to the feed arm 40. The position detecting substrate 52 detects a lateral displacement of the rack 48.

The feeding pressure varying motor 46 includes a worm 54 attached on its rotary shaft, and transmits its rotational force to the rack 48 via a worm wheel 56 and a pinion 58 integral therewith. The rack 48 has a slit 48*a* for moving itself. A lateral movement of the rack 48 is controlled by a pair of stepped screws 60. A pressure applying spring 64 has its one end connected to one end of the rack 48 via a hook bracket 62, and has the other end thereof coupled to a pressure applying arm 50 via a pulley 66. The pressure applying arm 50 is supported by a shaft 68 attached to the feed stay 44, and is longitudinally movable. The other end of the pressure applying spring 64 is positioned below a rotational center of the pressure applying arm 50. In other words, the rotational moment is generated at the pressure applying arm 50 by an urging force of the pressure applying spring 64. This rotational moment serves as a pressure for pushing the feed arm 40, i.e., a feeding pressure. Whenever the rack 48 moves in the direction L, the pressure applying spring 64 increases its urging force, i.e. the feeding pressure is increased.

The rack 48 has contact pieces 70 at its end near the position detecting substrate 52, which has detecting patterns (not shown) thereon, and detects the lateral movement of the rack 48 by detecting positions of the contact pieces 70 on the detecting patterns. FIG. 1 shows feeding pressure regulator 22 viewed from the direction P in FIG. 2.

The multiple sheet feeding sensor 32 includes a light emitting diode and a photodiode which are positioned on the opposite sides of the sheet feed path, and detects multiple sheet feeding on the basis of a variation of light intensity.

Figure 3:
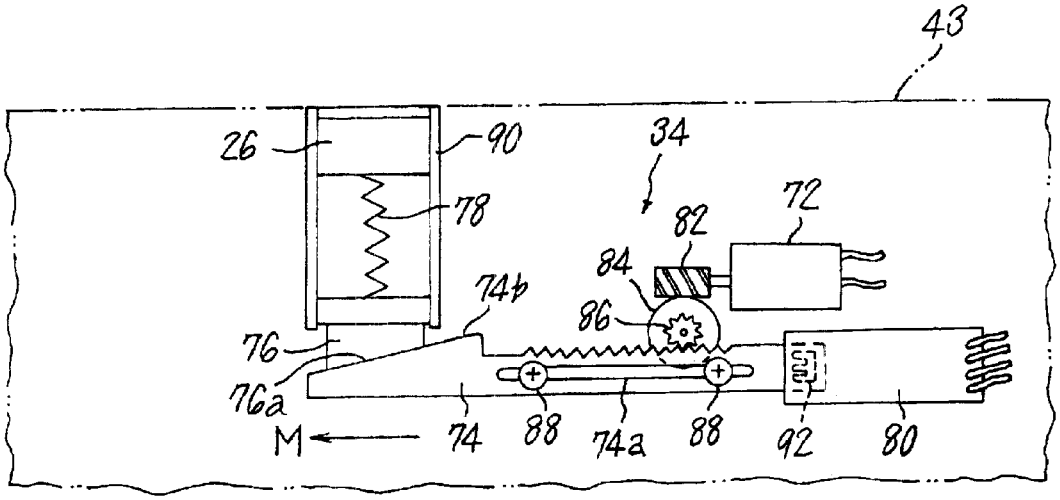
FIG. 3 is an enlarged rear view of a separating pressure regulator, viewed from a side S shown in FIG. 1.

Referring to FIG. 3, the separating pressure regulator 34 mainly includes a separating pressure varying motor 72, a rack 74, a pressing plate 76, a pressure applying spring 78, and a position detecting substrate 80. The rack 74 is movable transversely of the sheets 18 by the separating pressure varying motor 72. The pressing plate 76 is longitudinally displaced by the rack 74. The pressure applying spring 78 transmits the longitudinal displacement of the pressing plate 76 to the separating pad 26.

Similarly to the feeding pressure regulator 22, the separating pressure varying motor 72 receives a worm 82 at its rotary shaft, so that it transmits a rotational force of the rotary shaft to the rack 74 via a worm wheel 84 and a pinion 86 integral with the worm wheel 84. The rack 74 has a slit 74*a*, and has its lateral movement controlled by a pair of stepped screws 88 in the slit 74*a*.

The rack 74 has a tapered surface 74*b* at its one end near the pressing plate 76. The pressing plate 76 also has a tapered surface 76*a* in accordance with the tapered surface 74*b*. Although not shown in FIG. 1, the separating pad 26 and the pressing plate 76 are longitudinally moved by a guide 90. When the rack 74 is moved in the direction M, the pressing plate 76 is lifted, so that the separating pressure is raised in accordance with the increase of the urging force of the pressure applying spring 78. Similarly to the feeding pressure regulator 22, the position detecting substrate 80 of the rack 74 has contact pieces 92, so that an amount of displacement of the rack 74 is detected on the basis of positions of the contact pieces 92 on detecting patterns (not shown) of the position detecting substrate 80. FIG. 3 shows the separating pressure regulator 34 viewed from the direction S in FIG. 1.

Figure 4:
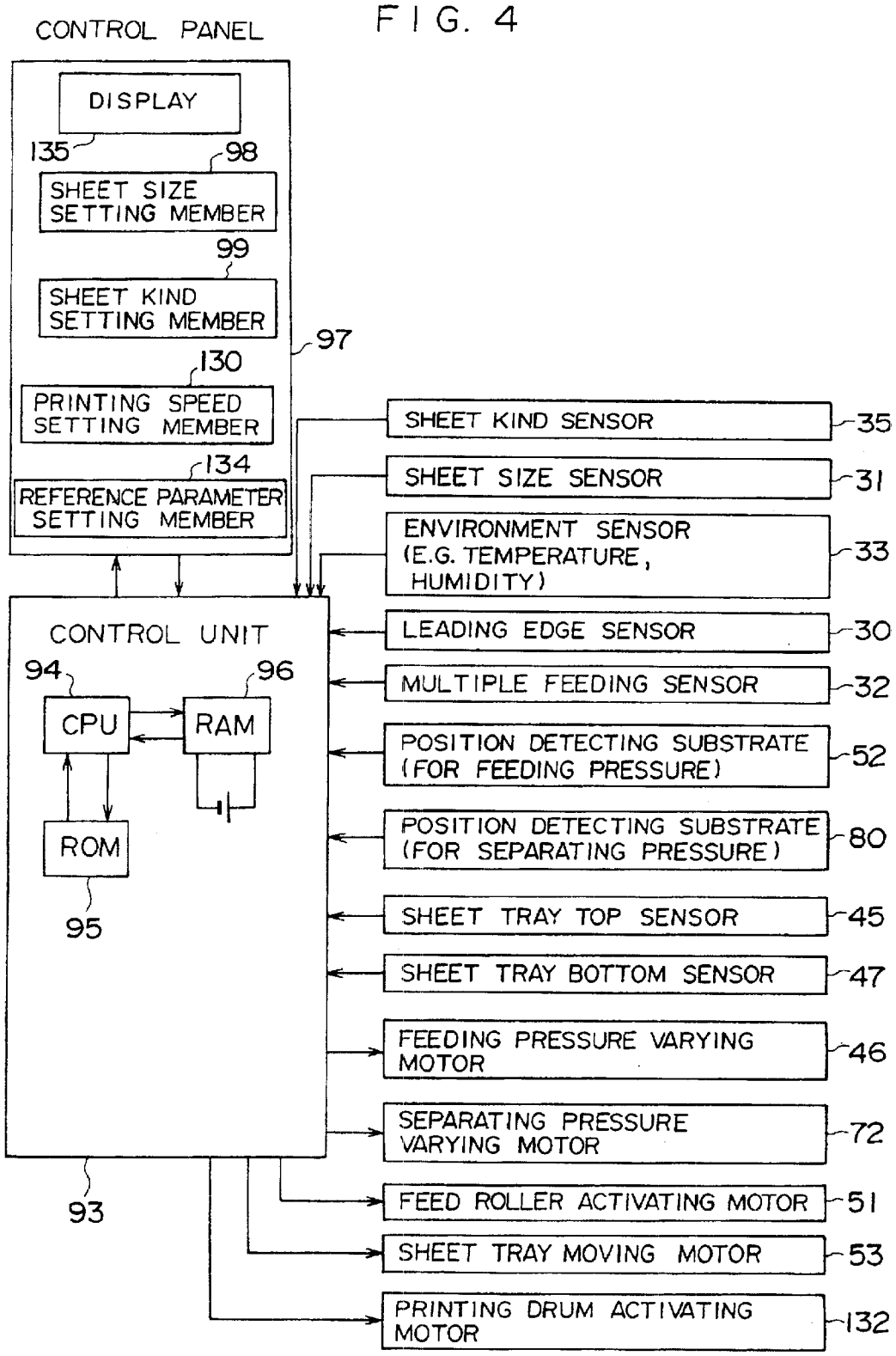
FIG. 4 is a block diagram of a control unit.

The sheet feeding apparatus 4 further includes sensors and devices as shown in FIG. 4, e.g. a sheet size sensor 31, an environment sensor 33, a sheet kind sensor 35, a sheet tray top sensor 45, a sheet tray bottom sensor 47, a motor 51 for activating the feed roller 20, a motor 53 for longitudinally moving the sheet tray 16, and a control panel 97. The control panel 97 is provided with a sheet size setting member 98, a sheet kind setting member 99, a printing speed setting member 130, a reference parameter setting member 134, and a display 135. The environment sensor 33 detects temperature and humidity in the stencil duplicating machine 2. The sheet kind sensor 35 detects a thickness of sheets.

Referring to FIG. 4, the control unit 93 is constituted by a CPU 94 (i.e. a microcomputer), and a ROM 95 and a RAM 96 as storage. The ROM 95 stores reference sheet feeding times obtained through experiments. The RAM 96 stores reference sheet feeding times updated in accordance with various pieces of information.

The control unit 93 receives output signals from the leading edge sensing element 30, multiple feeding sensor 32, position detecting substrates 52 and 80, sheet size sensor 31, sheet kind sensor 35 (for detecting a thickness or quality of the sheets), environment sensor 33, sheet tray top sensor 45, sheet tray bottom sensor 47, sheet size setting member 98, sheet kind setting member 99, printing speed setting member 130, and reference parameter setting member 134. The control unit 93 then outputs signals to the feed pressure varying motor 46, separating pressure varying motor 72, feed roller activating motor 51, sheet tray moving motor 53, printing drum activating motor 132, and control panel 97. The control unit 93 then provides signals to these motors and display 135 so as to control their operations.

Figure 5:
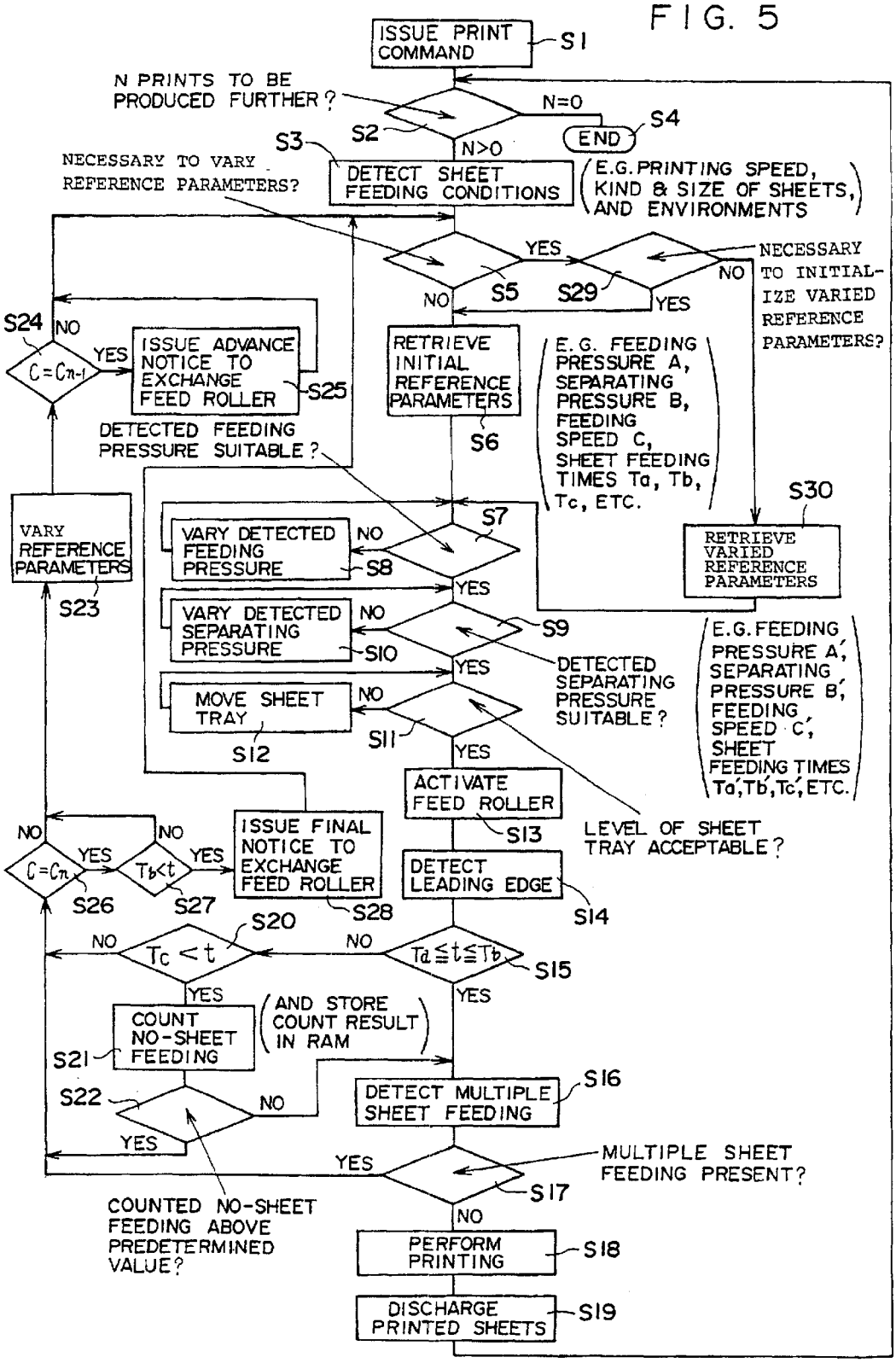
FIG. 5 is a flowchart showing a sheet feeding operation.

The sheet feeding apparatus 4 operates in a sequence shown in FIG. 5 when a sheet feeding time t is detected for one sheet by the sheet feeding time sensor 29. A size of sheets 18 is set by the sheet size setting member 98. A print command is issued using the control panel 97 (step S1). The number of remaining prints to be produced is checked (step S2). When the number of remaining prints is not 0, the control unit 93 detects sheet feeding conditions (step S3).

If there is no remaining print to be produced, the printing operation is completed (step S4).

The sheet feeding conditions, e.g. a printing speed, a kind and size of sheets, and environmental factors such as humidity and temperature, are detected and set. In this embodiment, the sheet size is specified by the sheet size setting member 98.

It is checked whether or not it is necessary to vary reference parameters (step S5). If not, the reference parameters stored in the ROM 95 are retrieved on the basis of the detected sheet feeding conditions for the specified sheet size (step S6). The reference parameters are: the feeding pressure A ($A_1$, $A_2$, . . . $A_n$); separating pressure B ($B_1$, $B_2$, . . . $B_n$); sheet feeding speed C ($C_1$, $C_2$, . . . $C_n$); minimum sheet feeding time Ta ($Ta_1$, $Ta_2$, . . . $Ta_n$); maximum sheet feeding time Tb ($Tb_1$, $Tb_2$, . . . $Tb_n$); and sheet feeding time Tc ($Tc_1$, $Tc_2$, . . . $Tc_n$) beyond which no-sheet feeding is counted (called the "no-sheet feeding time Tc"). The reference parameters are stored in the ROM 95, and are retrieved on the basis of sheet feeding conditions (a kind and size of sheet, etc.) as initial reference parameters. They will be varied if there is any change in the sheet feeding conditions. The varied reference parameters will be retrieved if necessary in a succeeding feeding operation. Both the initial and varied reference parameters are stored in the RAM 96.

Figure 6:
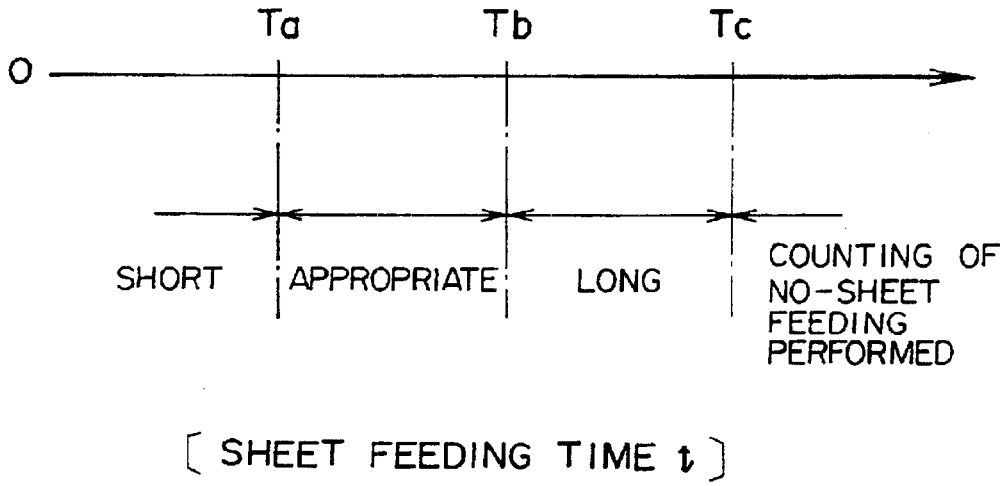
FIG. 6 shows an appropriate range of sheet feeding times.

The minimum and maximum sheet feeding times Ta and Tb, and the no-sheet feeding time Tc have the relationship as shown in FIG. 6. Specifically, when $t<Ta$, the sheet feeding time t is too short. When $Ta \leqq t \leqq Tb$, the sheet feeding time t is appropriate. When $Tb<t \leqq Tc$, the sheet feeding time is rather long but acceptable. When $Tc<t$, the sheet feeding time is too long, i.e. no sheet is fed. The sheet feeding speed denotes a revolution speed of the sheet feeding roller 20.

Temperature and humidity in the stencil duplicating machine 2 detected by the environment sensor 33 are also considered as conditions for retrieving the initial reference parameters. Therefore, it is possible to set the reference parameters more precisely, and to minimize occurrences of no-sheet feeding or multiple sheet feeding.

The feeding pressure detected by the position sensor 52 is compared with the retrieved initial reference feeding pressure (step S7), i.e., it is checked whether or not the detected feeding pressure is suitable to the specified sheet size. If not, the,feeding pressure varying motor 46 is activated in order to vary the detected feeding pressure (step S8). The varied feeding pressure is stored in the RAM 96 as a varied reference feeding pressure, which may be used as an initial reference feeding pressure for a next printing operation.

The separating pressure detected by the position detecting substrate 80 is compared, with respect to its suitability, with the initial reference separating pressure (step S9). If not, the detected separating pressure is varied (step S10). The varied separating pressure is stored in the RAM 96 as updated data, which may be used as an initial reference separating pressure for the next printing operation of the same sheet size.

Thereafter, a height of the sheet tray 16 is checked as to whether or not it is suitable (step S11). If not, the motor 53 for moving the sheet tray 16 is activated in order to adjust the height of the sheet tray 16 (step S12).

The feed roller activating motor 51 is then activated in order to rotate the feed roller 20 (step S13). The feed roller activating motor 51 is a stepping motor, and is activated in response to pulses which are supplied by the control unit 93 in accordance with the retrieved initial reference sheet feeding speed C.

The leading edge sensing element 30 detects the leading edge of the sheet 18 in front of the register rollers 28 (step S14). The control unit 93 also takes charge of a part of the sheet feeding time sensor 29, and calculates a sheet feeding time t between a rotation command for the feed roller 20 and detection of the leading edge of the sheet 18 by the leading edge sensing element 30. It is checked whether or not the detected sheet feeding time t is between the minimum reference sheet feeding time Ta and the maximum reference sheet feeding time Tb (i.e., whether or not the sheet feeding time t is within the proper range ($Ta \leqq t \leqq Tb$))(step S15). When the sheet feeding time t is appropriate, multiple sheet feeding is checked (step S16). It is checked whether or not there occurs multiple sheet feeding (step S17). If no multiple sheet feeding is detected, the sheet 18 will be printed (step S18) and delivered onto the printed sheet tray (step S19).

In this embodiment, the leading edge sending element 30 substantially constitutes the sheet feeding time sensor 29, which enables the sheet feeding time t to be detected by a simple structure.

In the embodiment, the control unit 93 calculates the sheet feeding time t as described above. Alternatively, the sheet feeding time sensor 29 may be configured as follows. Two leading edge sensing elements 30 may be separately disposed in the sheet feed path between the separating pad 26 and the register rollers 28 (shown in FIG. 1). Thus, the sheet feeding time sensor 29 detects a time for the sheet 18 to pass through these leading edge sensing elements 30. In this case, the sheet feeding time t is detected while the sheet 18 is being steadily conveyed, so that the sheet feeding time t can be more reliably measured and controlled. Still further, the sheet feeding time sensor 29 may be independent from the control unit 93, detect a sheet feeding time t, and provide it to the control unit 93.

When the detected sheet feeding time t is not between the minimum and maximum reference sheet feeding times Ta and Tb (i.e. not $Ta \leqq t \leqq Tb$), it is checked in step S20 whether or not the sheet feeding time t is longer than the no-sheet feeding time Tc (i.e. $Tc<t$). Conversely, if the sheet feeding time t is longer than the no-sheet feeding time Tc (i.e. $Tc<t$), counting of no-sheet feeding is performed (step S21), and a counted result of no-sheet feeding is stored in the RAM 96. Next, it is checked whether or not the counted result of no-sheet feeding is equal to or larger than the predetermined value (step S22). If not, the control returns to the step prior to the detection of multiple sheet feeding in step S16. If the counted result of no-sheet feeding is equal to or larger than the predetermined value, the retrieved initial reference sheet feeding time t will be varied. Thus, the counted result of no-sheet feeding will be cleared (step S23).

It is assumed here that the detected sheet feeding time t is equal to or shorter than the no-sheet feeding time Tc, i.e. either $t<Ta$ or $Tb<t \leqq Tc$, as shown in FIG. 6. In this case, counting of no-sheet feeding is not performed, but the initial reference sheet feeding time t has to be adjusted. If multiple sheet feeding is detected in step S17, the initial reference sheet feeding time t has to be varied.

As can be seen from FIG. 6, the length of the initial reference sheet feeding time t includes a tolerance in order that the sheet feeding speed C can be reliably adjusted considering various factors related to the sheet feeding operation. The detected sheet feeding time t can be adjusted as in the foregoing case by controlling the revolution speed of the feed roller 20 only when the detected sheet feeding time t differs from the initial reference sheet feeding time by an amount which is larger than a predetermined amount.

When the detected sheet feeding speed C is equal to $C_{n-1}$ which is one level prior to the final value $C_n$ (step S24), there is not sufficient room for adjusting the initial reference sheet feeding speed C because of the wearing of the feed roller 20. The control unit 93 outputs a signal to the display 135 in order to issue an advance notice that the time for exchanging the feed roller 20 is approaching (step S25). In response to the advance notice, the operator will obtain a fresh feed roller 20. When the sheet feeding speed C becomes equal to the final value $C_n$ (step S26) and the sheet feeding time t becomes larger than the maximum sheet feeding time Tb (i.e. $Tb<t$)(step S27), the control unit 93 gives the operator a final notice "Exchange feed roller" via the display 135 (step S28). In response to the warning, the operator will exchange the existing feed roller 20 with the fresh feed roller 20 at hand.

In order for the operator to inspect no-sheet feeding of a worn-out sheet feed roller 20, he or she has to be skilled in such an inspection job. Thus, the inspection job would become unreliable, and would be disadvantageous in the following respects: a time necessary for determining a replacement time; sheets jammed and wasted by no-sheet feeding; and waste of time due to non-operating period of the stencil duplicating machine when a fresh feed roller is being obtained and when the worn-out feed roller is being exchanged. However, these problems can be overcome by exchanging the worn-out feed roller in response to the advance and final notices concerning the replacement which are issued on the basis of the data obtained by the related sensors.

The operator or maintenance personnel can set the initial reference parameters as desired via the reference parameter setting member 134 on the control panel 97. Further, each current reference parameter (which is updated through detection during the sheet feeding operation) can be initialized whenever the sheet feed roller 20 is exchanged, or whenever the operator wishes.

Thus, it is possible for the sheet feeding apparatus to precisely handle user's particular sheets which do not satisfy requirements for standard sheets.

Whenever the worn-out feed roller is replaced with a fresh one, the current reference parameters are initialized. The sheet feeding apparatus can start its operation in an optimum state. For example, even when an abnormal sheet feeding time is determined for non-standard sheets, it can be cleared immediately after such sheets are printed and discharged. The sheet feeding apparatus learns varying sheeting feeding conditions and flexibly copes with any kind of sheets.

When it is determined to be necessary to vary initial reference parameters in step S5, it is checked, in step S29, whether or not varied reference parameters should be initialized using the reference parameter setting member 134. If not, the varied reference parameters stored in the RAM 96 will be retrieved similarly to the initial reference parameters (step S30). The varied reference parameters are: the feeding pressure A'; the separating pressure B'; the sheet feeding speed C': the minimum sheet feeding time Ta': the maximum sheet feeding time Tb'; and the no-sheet feeding time Tc'. A varied reference parameter A', B', C', Ta', Tb' or Tc' is one of respective values of the reference parameters A, B, C, Ta, Tb or Tc which are stored in the ROM 95. For example, when the value $A_1$ of the reference feeding pressure A is varied to $A_2$, it becomes a "varied reference feeding pressure A'".

When the varied reference parameters are determined to be initialized in step S29, the initial reference parameters will be retrieved for the current printing operation from the reference parameters in the ROM 95.

The detected sheet feeding speed C is varied by adjusting the revolution speed of the feed roller 20 through operating the sheet feed roller activating motor 51 under the control of the control unit 93. It is assumed that the sheet feeding time t detected by the sheet feeding time sensor 29 is much longer than the reference sheet feeding time shown in FIG. 6. In this case, the detected sheet feeding speed is raised by one adjustment level. Otherwise, the detected sheet feeding speed is reduced by one adjustment level. The detected sheet feeding speed is adjustable either during the sheet feeding operation and on a real-time basis, or after the sheet feeding operation.

If the sheet feeding time t increased by one adjustment level still deviates from the reference sheet feeding time, it will be further increased by another adjustment level. Conversely, if the sheet feeding time t reduced by one adjustment level still deviates from the reference sheet feeding time, it will be further reduced by another adjustment level. Further, if the sheet feeding time t extensively deviates from the reference sheet feeding time, it may be first set to a value which is larger or smaller by three adjustment levels than the reference sheet feeding time, and may be then reduced or increased by one adjustment level. The sheet feeding time t can be reliably and optimally controlled when each adjustment level is finely set.

The sheet feeding speed C is varied in two ways. One is to shorten the time taken for the sheet feed roller activating motor 51 to reach a predetermined revolution speed from its stationary state, and the other is to vary the maximum revolution speed of the motor 51. Tables showing speed curves related to the acceleration and the maximum speed of the motor 51 have been stored in the ROM 95. As described previously, the motor 51 is the stepping motor, which means that it can be easily adjusted in steps by changing a frequency of pulses applied thereto.

The present invention features that the detected shorter or longer sheet feeding time t is adjustable by reducing or increasing it by one adjustment level without interrupting the operation of the stencil duplicating machine, which promotes effective execution of the printing cycle.

When the count of no-sheet feeding exceeds the predetermined value, it is also possible to increase the feeding pressure A by one adjustment level through activation of the feeding pressure varying motor 46 in addition to the foregoing control of the sheet feeding speed. Further, when the multiple sheet feeding is detected by the multiple sheet feeding sensor 32, the separating pressure B may be increased by one adjustment level by activating the separating pressure varying motor 72. Similarly to the sheet feeding speed, the separating pressure B can be increased or reduced in a plurality of adjustment levels as desired.

Although the count of no-sheet feeding does not exceed the predetermined value, if the sheet feeding time t deviates from the reference sheet feeding time, the feeding pressure may be adjusted. Similarly to the sheet feeding speed, the feeding pressure A can be controlled in a plurality of adjustment levels, or it can be increased or reduced as desired. It is possible to reliably suppress occurrences of multiple sheet feeding and no-sheet feeding.

It is assumed that the sheet feeding operation is started using the varied reference parameters. If sheet feeding conditions vary in this state, the varied reference parameters will be further varied. In other words, when sheets of the same kind are continuously used but there are some changes in the sheet feeding conditions, the varied reference parameters will be varied accordingly during or after the sheet feeding operation. Even when the feed roller 20 is worn out, it can temporarily continue feeding sheets by varying the feeding speed. This is effective in lengthening a usable period of the feed roller 20.

The latest feeding speed, feeding pressure, separating pressure and so on are stored in the RAM 96 as updated data for succeeding sheet feeding operations. The updated data remain stored even after the main switch is turned off.

Figure 7:
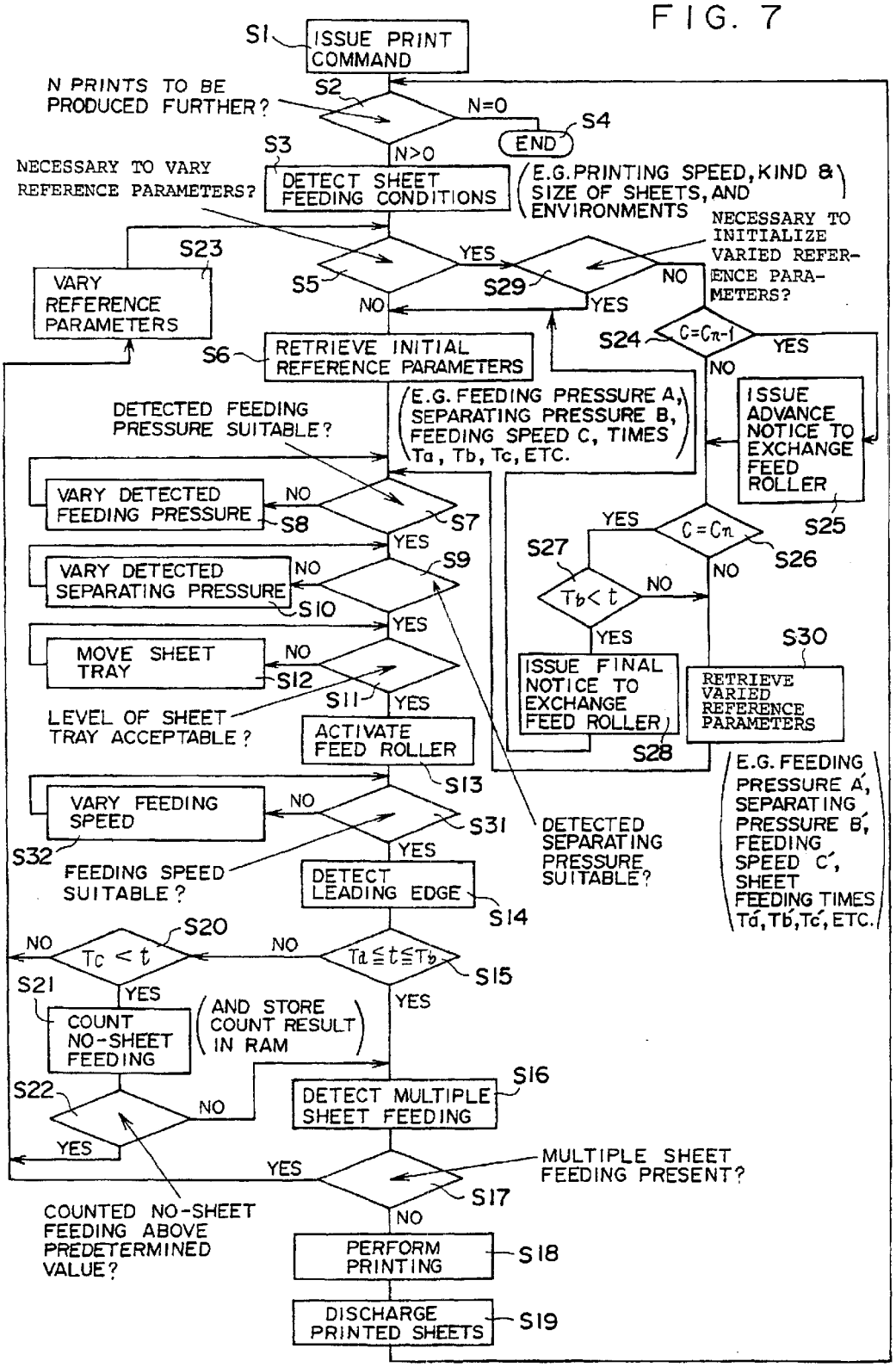
FIG. 7 is a flowchart showing a sheet feeding operation in a modified example.

FIG. 7 is a flowchart showing a sequence of a modified sheet feeding operation. The following describe the operation which differs from the operation shown in FIG. 5.

In this example, the feed roller activating motor 51 is a DC motor. An encoder disc (not shown) is attached to the rotation axis of the feed roller 20 in order to be rotatable in synchronization with the feed roller 20. A sensor connected to the control unit 93 detects a rotational displacement of the encoder disc. A mechanism for detecting a revolution speed of the feed roller 20 is realized similarly to a mechanism (FIG. 9) for detecting a rotational displacement of the feeding pressure varying motor 112 in a modified sheet feeding apparatus in which the sheet tray is moved by varying a pressure applied thereto, as will be described later.

When the feed roller 20 is rotated by the feed roller activating motor 51 (step S13), the revolution speed of the feed roller 20 (i.e. the sheet feeding speed), detected by the sensor, is compared with the retrieved initial reference sheet feeding speed, thereby checking whether or not the detected initial sheet feeding speed is suitable (step S31). If not, the control unit 93 adjusts the revolution speed of the feed roller activating motor 51 in accordance with the initial reference sheet feeding speed, i.e. the detected sheet feeding speed is adjusted (step S32).

In the operation sequence shown in FIG. 7, it is checked in step S29 whether or not the varied reference parameters should be initialized. If not, it is checked whether or not the detected sheet feeding speed C is equal to $C_{n-1}$ which is one level prior to the final value $C_n$ of the reference sheet feeding speeds (step S24). When the detected sheet feeding speed C is equal to $C_{n-1}$, it represents that there is hardly any room for adjusting the initial reference sheet feeding speed because of the wearing of the sheet feeding roller 20. The control unit 93 outputs a signal to the display 135 in order to give an advance notice concerning the time to exchange the feed roller 20 (step S25). In response to the advance notice, the operator will obtain a fresh sheet feeding roller 20.

If the detected sheet feeding speed C is not $C_{n-1}$, it is checked whether or not the sheet feeding speed C is equal to the final value $C_n$ (step S26). If not, the initial reference sheet feeding speed C is adjustable. Therefore, the varied reference parameters will be retrieved (step S30). The sheet feeding operation will be performed using the varied reference parameters. On the other hand, if the detected sheet feeding speed C is equal to $C_n$ and if the sheet feeding time t is longer than the maximum sheet feeding time Tb (step S27), the display 135 indicates a final notice "Exchange the feeding roller" (step S28). In response to the notice, the operator will exchange the sheet feeding roller 20 with the fresh one at hand.

Following the final notice, the printing operation will be suspended. The sheet feeding speed, feeding pressure, and so on will be initialized after the sheet feeding roller is exchanged.

In the foregoing embodiment, the sheet feeding time t detected for one sheet is compared with the initial reference sheet feeding time. Alternatively, sheet feeding times of a plurality of sheets may be detected, so that an average sheet feeding time may be compared with the initial reference sheet feeding time. In such a case, it is possible to prevent the initial reference sheet feeding time from being varied because of sporadic abnormal sheet feeding.

In the foregoing case, sheet feeding times which deviate from the initial reference sheet feeding time, i.e., sheet feeding times during which counting of no-sheet feeding is performed (Tc<t), are not used for averaging the detected sheet feeding times. This is also effective in preventing the initial reference sheet feeding time from being varied because of sporadic abnormal sheet feeding. Therefore, no-sheet feeding and multiple sheet feeding can be more reliably suppressed.

In the foregoing embodiment, one of the sheet feeding conditions is detected by the sheet size setting member 98. Alternatively, a sheet size sensor may detect a sheet size and produce a signal indicative of the detected sheet size. In this case, once the sheet size is detected, a reference sheet feeding time associated with the detected sheet size will be retrieved from the ROM 95. Then, a detected sheet feeding time will be compared with the reference sheet feeding time associated with the detected size.

A sheet kind sensor may be provided in order to detect a thickness of a sheet. A detected sheet feeding time is compared with the reference sheet feeding time associated with the detected thickness and predetermined for the corresponding sheet kind.

When the sheet kind setting member 99 sets a sheet kind in step S3 and sheet feeding conditions are detected, initial reference parameters associated with the set sheet kind will be retrieved from the ROM 95. Thereafter, the detected sheet feeding time will be compared with the initial reference sheet feeding time.

In step S3, the printing speed setting member 130 sets a printing speed, and sheet feeding conditions are detected. Then, initial reference parameters associated with the set printing speed are retrieved from the ROM 95. The detected sheet feeding time for the set printing speed will be compared with the initial reference sheet feeding time.

Further, only when a predetermined sheet kind is specified, a detected sheet feeding time associated with the specified sheet kind may be compared with the reference sheet feeding time predetermined for the specified kind, and a detected feeding pressure may be adjusted. Therefore, no-sheet feeding can be reliably prevented. If non-standard sheets are selected, it is possible to prevent retrieval of reference parameters which are not appropriate for such sheets.

Figure 8:
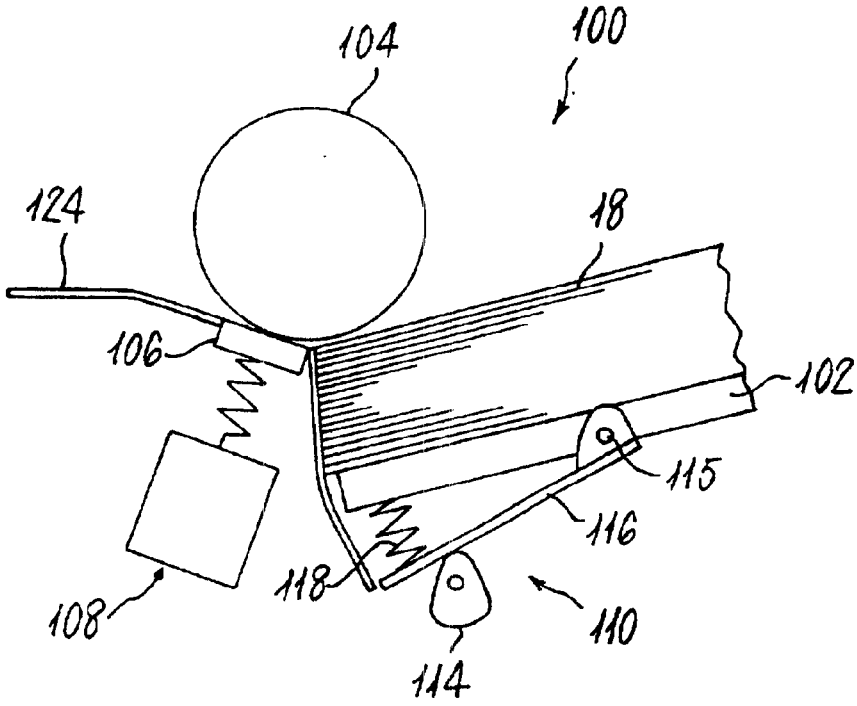
FIG. 8 is a side view of the main part of a feeding pressure regulator in the modified example of the invention.
Figure 9:
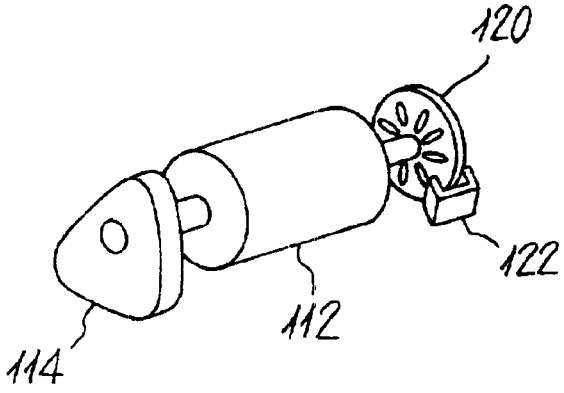
FIG. 9 is a side perspective view of the main part of the feeding pressure regulator.
Figure 10:
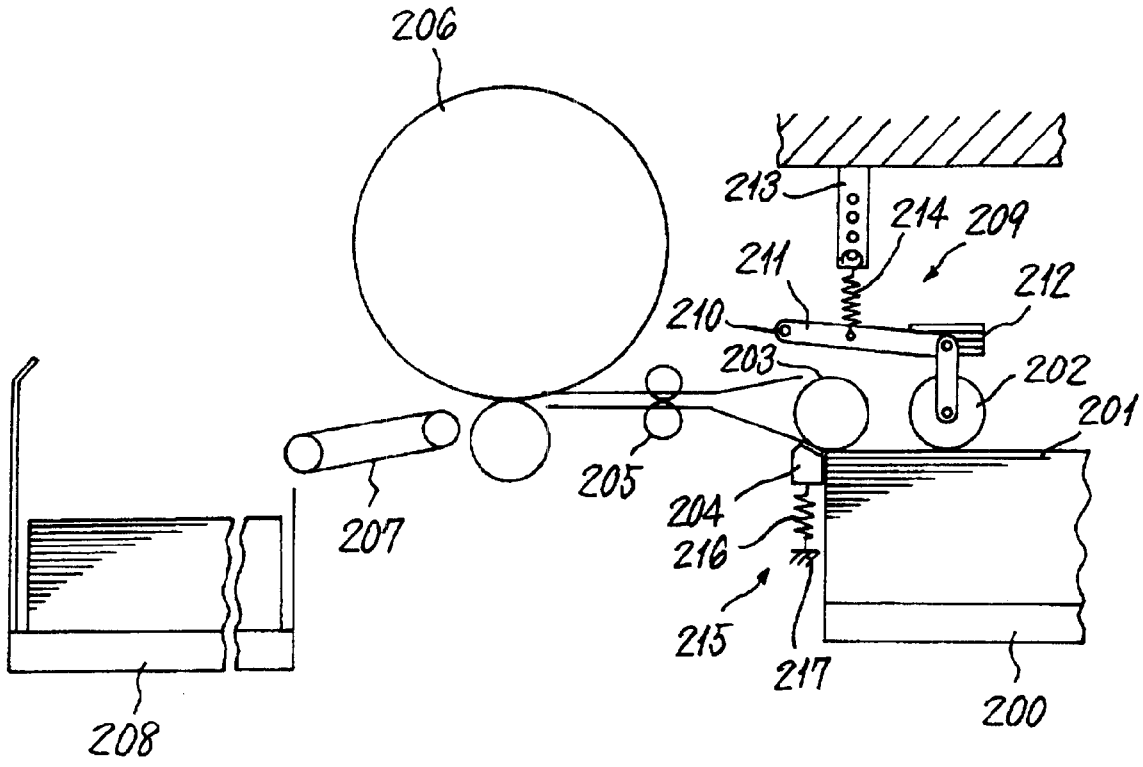
FIG. 10 PRIOR ART
FIG. 10 is a schematic side view of a stencil duplicating machine into which a sheet feeding apparatus of the prior art is incorporated.

FIGS. 8 and 9 show a modified example for adjusting the sheet feeding pressure in the foregoing embodiment. In this case, the sheet feeding pressure is adjusted by varying a sheet tray pushing pressure.

In this example, a sheet feeding apparatus 100 mainly comprises a sheet tray 102, a sheet feeding/separating roller 104, a separating pad 106, a separating pressure regulator 108, a feeding pressure regulator 110, and a control unit (not shown). The sheet tray 102 is movably supported by a fulcrum 115.

The feed pressure regulator 110 mainly includes a feeding pressure varying motor 112, a cam 114 fixed to a rotation axis of the feed pressure varying motor 112, a pressure varying plate 116, and a pressure applying spring 118 disposed between the pressure varying plate 116 and the sheet tray 102. The pressure varying plate 116 is supported by the fulcrum 115 at its one end, and is longitudinally movable at the other end thereof. The feeding pressure varying motor 112 has an encoder disc 120, which is synchronously rotatable with the motor 112. A sensor 122 connected to the control unit detects a rotational displacement of the encoder disk 120. In FIG. 8, reference numeral 124 denotes a sheet guide.

When the feeding pressure varying motor 112 is activated and an angle of the cam 114 is varied, the pressure varying plate 116 is displaced. An urging force of the spring 118 varies with the displacement of the pressure varying plate 116, thereby varying the sheet feeding pressure. If a detected sheet feeding time exceeds the reference sheet feeding time, a signal is provided to the feeding pressure varying motor 112, which is activated in accordance with a level to control the sheet feeding pressure, so that the sheet feeding pressure will be increased as described in the foregoing embodiment. The sheet feeding apparatus 100 operates similarly to the sheet feeding apparatus of the foregoing embodiment.

FIG. 8 shows the separating pressure regulator 108 in a simplified manner, which is similarly structured as in the foregoing embodiment.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path;

(b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) a sheet kind sensor, wherein when the sheet kind sensor detects a thickness of a sheet, a sheet feeding time of a sheet of the detected thickness is compared with a reference sheet feeding time predetermined for the corresponding sheet kind.

2. The sheet feeding apparatus of claim 1, wherein the control unit also functions as a sheet feeding time sensing element of the sheet feeding time sensor.

3. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path; and (b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation, wherein the sheet feeding time sensor detects sheet feeding times of a plurality of sheets, and an average of detected sheet feeding times is compared with the reference sheet feeding times.

4. The sheet feeding apparatus of claim 3, wherein detected sheet feeding times which deviate from the reference sheet feeding time are not used for averaging the detected sheet feeding times.

5. The sheet feeding apparatus of claim 1 or 2, further comprising a sheet size sensor, wherein when the sheet size sensor detects a sheet size, a sheet feeding time of a sheet of the detected size is compared with a reference sheet feeding time predetermined for the corresponding sheet size.

6. The sheet feeding apparatus of claim 1 or 2, further comprising a sheet size setting member, wherein when the sheet size setting member sets a sheet size, a sheet feeding time of a sheet of the set size is compared with a reference sheet feeding time predetermined for the corresponding sheet size.

7. The sheet feeding apparatus of claim 1 or 2, further comprising a sheet kind setting member, wherein when the sheet kind setting member sets a sheet kind, a sheet feeding time of a sheet of the set kind is compared with a reference sheet feeding time predetermined for the corresponding sheet kind.

8. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path;

(b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) an environment sensor for detecting factors such as temperature and humidity in the image processing system, wherein a sheet feeding time under the detected temperature or humidity is compared with a reference sheet feeding time predetermined for the corresponding temperature or humidity.

9. The sheet feeding apparatus of claim 1 or 2, further comprising a member for issuing an advance notice concerning the time for exchanging the sheet feed roller when the revolution speed of the sheet feed roller reaches a predetermined value.

10. The sheet feeding apparatus of claim 1 or 2, further comprising a member for urging to exchange the sheet feed roller when the revolution speed of the sheet feed roller reaches the predetermined value and when the detected sheet feeding time exceeds the reference sheet feeding time.

11. The sheet feeding apparatus of claim 1 or 2, wherein the reference sheet feeding time is optionally determined.

12. The sheet feeding apparatus of claim 11, wherein the reference sheet feeding time can be updated, and an updated reference sheet feeding time can be optionally initialized.

13. The sheet feeding apparatus of claim 1 or 2, further comprising a printing speed setting member, wherein when the printing speed setting member sets a printing speed, a detected sheet feeding time for the set printing speed is compared with a reference sheet feeding time predetermined for the corresponding printing speed.

14. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path;

(b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) a multiple feed sensor for detecting multiple sheet feeding, disposed upstream of the register rollers in the sheet feeding path, and a sheet separating pressure regulating mechanism for regulating a sheet separating pressure, wherein when multiple sheet feeding is detected by the multiple feed sensor, the sheet separating pressure regulating mechanism regulates the sheet separating pressure.

15. The sheet feeding apparatus of claim 1 or 2, further comprising a sheet feeding pressure regulating member for regulating a sheet feeding pressure, wherein the sheet feeding pressure is regulated during or after the sheet feeding operation, on the basis of comparison between the reference sheet feeding time and the detected sheet feeding time.

16. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path; and (b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) a sheet feeding pressure regulating member for regulating a sheet feeding pressure, wherein the sheet feeding pressure is regulated during or after the sheet feeding operation, on the basis of comparison between the reference sheet feeding time and the detected sheet feeding time, and wherein each time a detected sheet feeding time exceeds the reference sheet feeding time, no-sheet feeding is counted once, and the sheet feeding pressure is adjusted when the count of no-sheet feeding exceeds a predetermined value.

17. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path; and (b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) a sheet feeding pressure regulating member for regulating a sheet feeding pressure, wherein the sheet feeding pressure is regulated during or after the sheet feeding operation, on the basis of comparison between the reference sheet feeding time and the detected sheet feeding time, and wherein only a predetermined sheet kind is specified, a detected sheet feeding time is compared with the reference sheet feeding time predetermined for the specified sheet kind.

18. A sheet feeding apparatus for an image processing system which includes register rollers periodically conveying a sheet from a sheet feed roller to a printing section, the sheet feeding apparatus comprising:

(a) a sheet feeding time sensor for detecting a sheet being positioned upstream of the register rollers in a sheet feeding path;

(b) a control unit for comparing the sheet feeding time detected by the sheet feeding time sensor with a reference sheet feeding time out of experimentally predetermined sheet feeding times, and controlling a revolution speed of the sheet feed roller on the basis of a compared result during or after a sheet feeding operation; and (c) a sheet kind setting member, wherein when the sheet kind setting member sets a sheet kind, a sheet feeding time of a sheet of the set kind is compared with a reference sheet feeding time predetermined for the corresponding sheet kind.

19. The sheet feeding apparatus of claim 18, wherein the control unit also functions as a sheet feeding time sensing element of the sheet feeding time sensor.

20. The sheet feeding apparatus of claim 18 or 19, further comprising a sheet size sensor, wherein when the sheet size sensor detects a sheet size, a sheet feeding time of a sheet of the detected size is compared with a reference sheet feeding time predetermined for the corresponding sheet size.

21. The sheet feeding apparatus of claim 18 or 19, further comprising a sheet size setting member, wherein when the sheet size setting member sets a sheet size, a sheet feeding time of a sheet of the set size is compared with a reference sheet feeding time predetermined for the corresponding sheet size.

22. The sheet feeding apparatus of claim 18 or 19, further comprising a member for issuing an advance notice concerning the time for exchanging the sheet feed roller when the revolution speed of the sheet feed roller reaches a predetermined value.

23. The sheet feeding apparatus of claim 18 or 19, further comprising a member for urging to exchange the sheet feed roller when the revolution speed of the sheet feed roller reaches the predetermined value and when the detected sheet feeding time exceeds the reference sheet feeding time.

24. The sheet feeding apparatus of claim 18 or 19, wherein the reference sheet feeding time is optionally determined.

25. The sheet feeding apparatus of claim 24, wherein the reference sheet feeding time can be updated, and an updated reference sheet feeding time can be optionally initialized.

26. The sheet feeding apparatus of claim 18 or 19, further comprising a printing speed setting member, wherein when the printing speed setting member sets a printing speed, a detected sheet feeding time for the set printing speed is compared with a reference sheet feeding time predetermined for the corresponding printing speed.

27. The sheet feeding apparatus of claim 18 or 19, further comprising a sheet feeding pressure regulating member for regulating a sheet feeding pressure, wherein the sheet feeding pressure is regulated during or after the sheet feeding operation, on the basis of comparison between the reference sheet feeding time and the detected sheet feeding time.

* * * * *